US010326237B1

(12) United States Patent
Campos et al.

(10) Patent No.: US 10,326,237 B1
(45) Date of Patent: Jun. 18, 2019

(54) HERMAPHRODITIC ELECTRICAL CONNECTION SYSTEM WITH MATING ASSIST DEVICE

(71) Applicant: TE CONNECTIVITY CORPORATION, Berwyn, PA (US)

(72) Inventors: Tyler Anton Campos, Winston Salem, NC (US); Daniel Franklin Stack, Kernersville, NC (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/987,387

(22) Filed: May 23, 2018

(51) Int. Cl.
*H01R 13/62* (2006.01)
*H01R 13/629* (2006.01)
*H01R 24/84* (2011.01)

(52) U.S. Cl.
CPC ..... *H01R 13/62938* (2013.01); *H01R 24/84* (2013.01)

(58) Field of Classification Search
CPC ..... H01R 13/62938; H01R 13/625
USPC ..... 439/157, 314, 372
See application file for complete search history.

(56) References Cited

U.S. PATENT DOCUMENTS 2,396,872 A * 3/1946 Miller ..... H01R 13/625 439/293
3,648,219 A * 3/1972 Goldman ..... H01R 13/518 439/157
3,657,681 A * 4/1972 Falkner ..... H01R 13/523 439/205
3,688,243 A * 8/1972 Yamada ..... H01R 13/28 439/293
3,745,511 A * 7/1973 Fussell ..... H01R 13/28 439/294
3,836,938 A * 9/1974 Barrett, Jr. ..... H01R 13/62 439/157
3,840,839 A * 10/1974 Smaczny ..... H01R 13/631 439/294
3,994,552 A * 11/1976 Selvin ..... E21B 17/028 439/278
4,014,600 A * 3/1977 Gisewsky ..... H01R 13/22 439/289
4,152,038 A * 5/1979 Inouye ..... H01R 13/629 439/153
4,840,574 A * 6/1989 Mills ..... B23K 9/323 439/157
5,010,426 A * 4/1991 Krenz ..... G11B 25/043 360/137

(Continued)

*Primary Examiner* — Neil Abrams
(74) *Attorney, Agent, or Firm* — Snell & Wilmer L.L.P.

(57) ABSTRACT

A connection system includes a first electrical connector, a second electrical connector, and a mating assist device. The first electrical connector includes a first housing that has a mating end. The second electrical connector includes a second housing that has a mating end. The second housing is a duplicate of the first housing. The mating end of the first housing is configured to mate to the mating end of the second housing during a mating operation. The mating assist device is mounted to the first housing and is configured to engage catch features protruding from an outer surface of the second housing. The mating assist device is configured to be rotated or pivoted relative to both the first and second housings to linearly pull the second electrical connector towards the first electrical connector during the mating operation via the catch features.

20 Claims, 6 Drawing Sheets

(56) References Cited

U.S. PATENT DOCUMENTS 5,230,635 A * 7/1993 Takenouchi ..... H01R 13/62938
439/153
5,829,994 A * 11/1998 Oda ..... H01R 13/62944
439/157
6,364,681 B1 * 4/2002 Watanabe ..... H01R 13/625
439/335
7,037,131 B1 * 5/2006 Chen ..... H01R 13/6215
439/362
7,104,826 B2 * 9/2006 Zahlit ..... H01R 13/625
439/314

* cited by examiner

HERMAPHRODITIC ELECTRICAL CONNECTION SYSTEM WITH MATING ASSIST DEVICE

BACKGROUND

The subject matter herein relates generally to electrical connection systems that are configured for use with mating assist devices to provide a mechanical advantage during mating.

Some electrical connection systems require relatively large mating forces to mate two complementary electrical connectors. In order to ease the physical burden on an operator tasked with mating the connectors, some electrical connection systems include mating assist devices. The mating assist devices are configured to provide a mechanical advantage, such as by converting rotational movement into linear movement of the connectors along a mating axis and/or using mechanics to provide an output force that is greater than an insertion force applied by the operator. The mating assist devices allow the operator to mate the connectors more efficiently and with less effort.

The mating connectors in known connection systems with mating assist devices have at least some features that differ between the two connectors. For example, a first connector may have mounting features for mounting the mating assist device to the first connector. The second connector that mates to the first connector may lack the mounting features, such that the mating assist device is not able to mount to the second connector. Furthermore, the second connector may include engagement features that are engaged by the mating assist device on the first connector during the mating operation in order to pull the connectors toward each other. The first connector may lack the engagement features. Because the two connectors have discrete and specialized features, the connectors may be more costly to produce and purchase than a connection system that utilizes hermaphroditic connectors. For example, molds and machines have to be prepared to produce two different connector shapes instead of one connector shape associated with hermaphroditic connectors.

Such a specialized connection system may also limit configuration options for the consumer. For example, a consumer may prefer that a mating assist device is mounted on a receptacle connector based for a specific installation, such as due to space constraints in the article to which the connectors are installed. But, if the mating assist device is mounted to a plug connector, the consumer is not able to selectively move the mating assist device for mounting to the receptacle connector without potentially purchasing additional specialized connectors.

A need remains for a connection system with a mating assist device that provides greater configuration flexibility at a lower cost than known connection systems.

BRIEF DESCRIPTION

In one or more embodiments of the present disclosure, a connection system is provided that includes a first electrical connector, a second electrical connector, and a mating assist device. The first electrical connector includes a first housing that has a mating end. The second electrical connector includes a second housing that has a mating end. The second housing is a duplicate of the first housing. The mating end of the first housing is configured to mate to the mating end of the second housing during a mating operation. The mating assist device is mounted to the first housing and is configured to engage catch features protruding from an outer surface of the second housing. The mating assist device is configured to be rotated or pivoted relative to both the first and second housings to linearly pull the second electrical connector towards the first electrical connector during the mating operation via the catch features.

In one or more embodiments of the present disclosure, an electrical connector is provided that includes a housing and a mating assist device. The housing defines a mating end and holds one or more electrical contacts. The housing includes multiple catch features protruding from an outer surface of the housing. The housing is hermaphroditic such that the mating end of the housing is configured to mate with a mating housing that is a duplicate of the housing and has mating catch features matching the catch features of the housing. The mating assist device is mounted to the housing proximate to the mating end. The mating assist device is configured to rotate or pivot relative to the housing during a mating operation to engage the mating catch features and linearly pull the mating housing towards the housing.

In one or more embodiments of the present disclosure, an electrical connector is provided that includes a housing and a lever. The housing defines a mating end and holds one or more electrical contacts. The housing includes protrusions protruding from an outer surface of the housing along opposite sides of the housing. The housing is hermaphroditic such that the mating end of the housing is configured to mate with a mating housing that is a duplicate of the housing and has mating protrusions matching the protrusions of the housing. The lever is mounted to the housing via the protrusions and is pivotable about the protrusions. The lever defines cam slots configured to receive the mating protrusions therein during a mating operation to linearly pull the mating housing towards the housing as the lever is pivoted relative to the housing.

DETAILED DESCRIPTION

Embodiments of the present disclosure provide a connection system with first and second electrical connectors and a mating assist device that provides a mechanical advantage to reduce insertion forces required to mate the first and second connectors. The first and second electrical connectors have hermaphroditic connector housings. For example, a housing of the first connector is a duplicate of a housing of the second connector. As used herein, the term "duplicate" means that the two reference components have the same size and shape as one another. For example, two duplicate components may be manufactured using the same instruments, tools, machines, molds, conditions, processes, and/or the like. The two duplicate components may be replicas or copies of each other, that are intended to be exactly alike or identical; however, it is recognized that two duplicate components may not be exactly identical to one another due to manufacturing inconsistencies, blemishes, post-manufacturing deformations and/or abrasions, and the like.

In at least one embodiment of the present disclosure, the housing of the first connector is configured to mate to the duplicate housing of the second connector at a mating interface to establish an electrically conductive pathway through the first and second connectors. The mating assist device is selectively mountable to each of the first and second connectors. When the mating assist device is mounted to the housing of the first connector, the mating assist device is configured to engage catch features protruding from the housing of the second connector. The operator may rotate or pivot the mating assist device relative to the two housings to cause the mating assist device to linearly pull the two housings towards each other at the mating interface.

Figure 1:
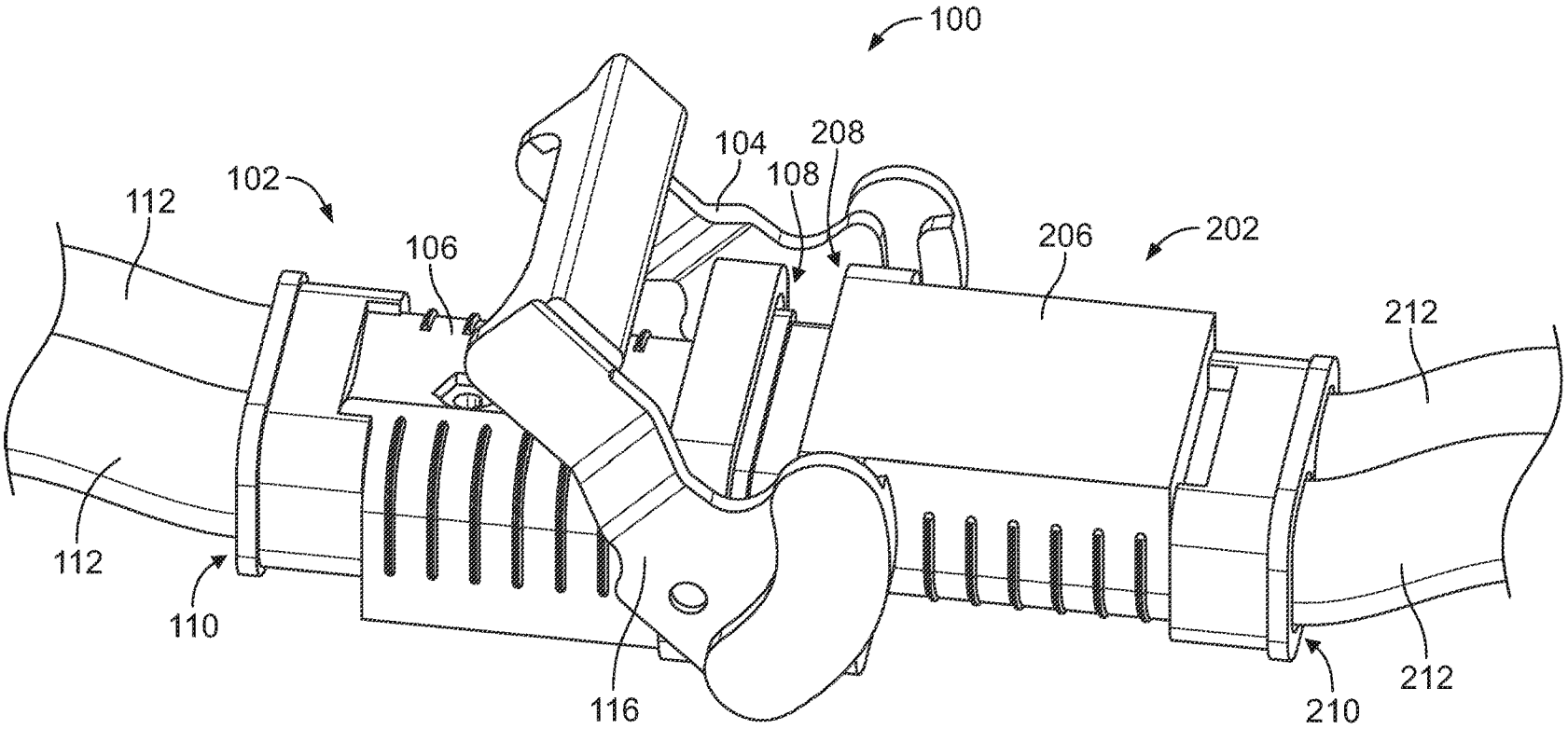
FIG. 1 is a perspective view of a connection system in accordance with an embodiment that includes a first electrical connector, a second electrical connector, and mating assist device.

FIG. 1 is a perspective view of a connection system 100 in accordance with an embodiment that includes a first electrical connector 102, a second electrical connector 202, and mating assist device 104. The first and second electrical connectors 102, 202 are partially mated in the illustrated embodiment. The mating assist device 104 is configured to reduce the insertion force that is required to mate the first and second connectors 102, 202. The mating assist device 104 may provide a mechanical advantage for moving the connectors 102, 202 towards each other from the illustrated partially mated position to a fully mated position. In the fully mated position, the first and second electrical connectors 102, 202 provide one or more electrical conduction paths across a mating interface between the connectors 102, 202. In the embodiments described herein, the first and second electrical connectors 102, 202 may be utilized in sealed or unsealed connector applications, and the sealed applications may include only one or multiple facial seals between the connectors 102, 202.

The first electrical connector 102 includes a first housing 106. The first housing 106 has a mating end 108 and a cable end 110. The first electrical connector 102 is connected to one or more electrical cables or wires 112 that protrude from the cable end 110 of the first housing 106. In alternative embodiment, the first housing 106 may be mounted to a circuit board or another device instead of electrical cables 112. The first connector 102 in the illustrated embodiment is an inline or linear connector such that the mating end 108 of the housing 106 is opposite the cable end 110. The first electrical connector 102 includes one or more electrical conductors, such as contacts 170 (shown in FIG. 4). The one or more electrical conductors are held by the first housing 106 within a cavity (shown in FIG. 3) thereof. The electrical conductors are terminated (e.g., electrically connected) to the one or more cables 112.

The second electrical connector 202 includes a second housing 206. The second housing 206 has a mating end 208 that engages the mating end 108 of the first housing 106 during the mating operation. The second housing 206 also includes a cable end 210 from which one or more electrical cables or wires 212 protrude. The cables 212 are terminated to electrical contacts held within the housing 206. In the illustrated embodiment, the second connector 202 is an inline or linear connector, like the first connector 102, such that the cable end 210 is opposite the mating end 208.

In one or more embodiments described herein, the second housing 206 is a duplicate of the first housing 106 of the first connector 102. For example, the first and second housings 106, 206 may be exact replicas or copies of each other, which have the same size, shape, and features. For example, the first and second housings 106, 206 may be molded using the same molds or dies and the same conditions and processes. The first and second connectors 102, 202 are hermaphroditic because each of the housings 106, 206 mates to a copy of itself. In an alternative embodiment, segments of the first and second housings 106, 206 at or proximate to the mating ends 108, 208 may be duplicates, while segments at or proximate to the cable ends 110, 210 may differ.

The mating assist device 104 is mounted to the first connector 102 in the illustrated embodiment. The mating assist device 104 is configured to engage catch features 214 (shown in FIG. 2) on the second housing 206 during the mating operation. The mating assist device 104 is rotatable or pivotable relative to both the first and second housings 106, 206. The mating assist device 104 and the connector housings 106, 206 are designed to convert the rotational or pivotal movement of the mating assist device 104 in a first direction into linear movement that pulls the first and second housings 106, 206 towards each other to achieve the fully mated position. Rotating or pivoting the mating assist device 104 in a second direction opposite the first direction may linearly push the housings 106, 206 apart for disconnecting the two connectors 102, 202. In the illustrated embodiment, the mating assist device 104 is a lever 116 that is pivotable relative to the first housing 106. But, the mating assist device 104 may have other shapes and configurations in other embodiments.

Although the mating assist device 104 is mounted to the first housing 106 in FIG. 1, the mating assist device 104 may be selectively mountable on either of the first and second housings 106, 206. The second housing 206 may be a duplicate of the first housing 106, so the mating assist device 104 mounts to the second housing 206 in the same way (e.g., same mounting mechanism, location, and orientation) that the mating assist device 104 is mounted to the first housing 106 in FIG. 1. The first electrical connector 102 and first housing 106 are also referred to herein simply as "connector 102" and "housing 106", respectively. The second electrical connector 202 and second housing 206 are also referred to herein as "mating connector 202" and "mating housing 206", respectively. Thus, the mating assist device 104 in FIG. 1 is mounted to the connector 102, and releasably engages the mating connector 202.

The connection system 100 may be installed and utilized in a multitude of applications. For example, the connection system 100 may be used to provide an electrical connection in automobiles, marine vessels, industrial vehicles (e.g., mining trucks, construction trucks, etc.), industrial machinery, appliance, and the like. In one non-limiting example, the connection system 100 may be installed in a battery disconnect system for a hybrid or fully electrical power system in a vehicle.

Figure 2:
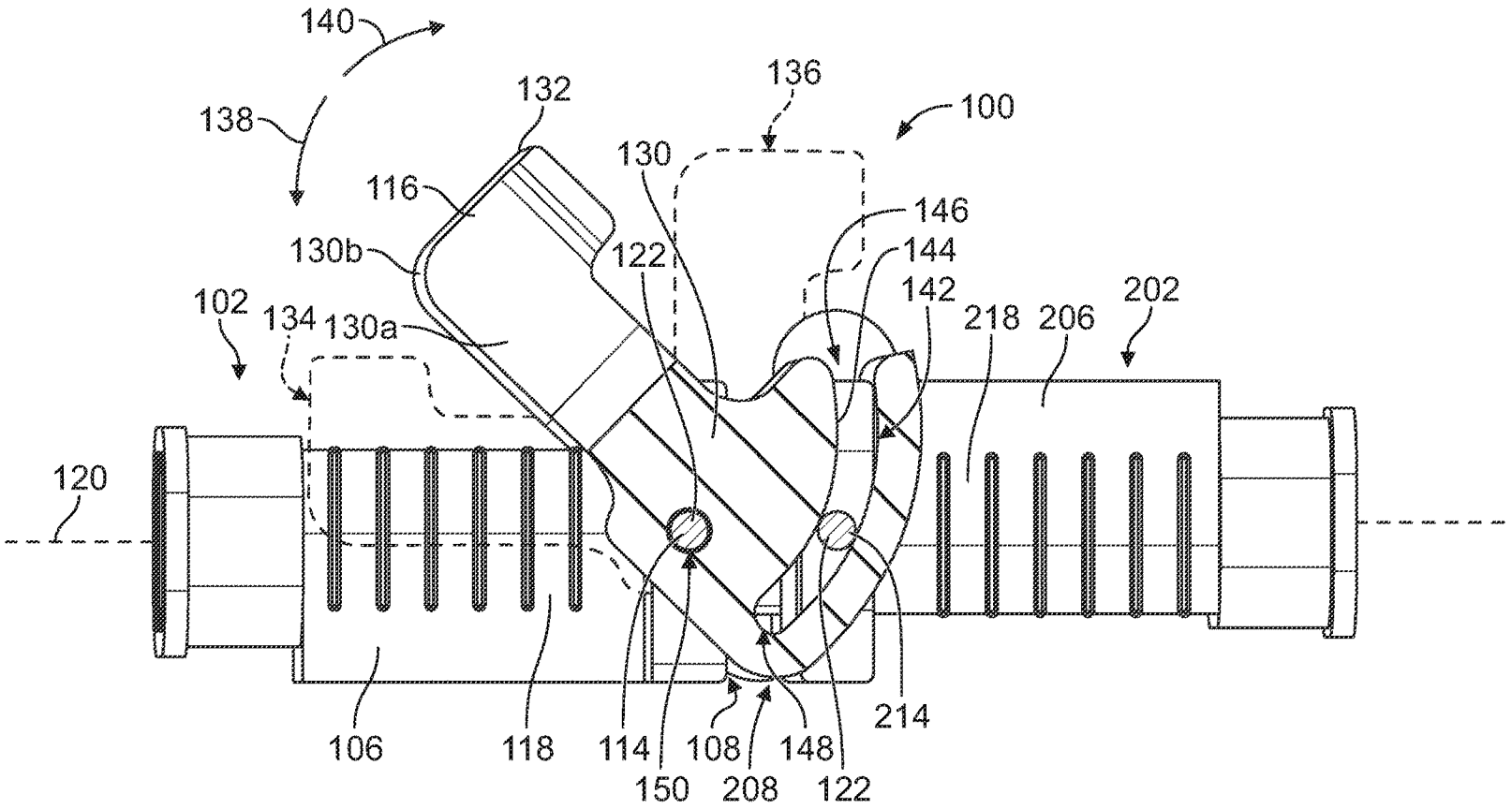
FIG. 2 is a side cross-sectional view of the connection system shown in FIG. 1.

FIG. 2 is a side cross-sectional view of the connection system 100 in the partially mated position shown in FIG. 1.

The cables 112, 212 of the connectors 102, 202 are not shown in FIG. 2. The cross-section is taken through an arm 130 of the lever 116, a catch feature 114 of the housing 106, and a catch feature 214 of the mating housing 206. The catch feature 214 of the mating housing 206 may be referred to herein as a "mating catch feature".

The catch feature 114 protrudes from an outer surface 118 of the housing 106. The catch feature 114 that is visible in the illustrated embodiment is located on the outer surface 118 that faces out of the page. The catch feature 214 of the mating housing 206 protrudes from an outer surface 218 of the mating housing 206. The catch feature 214 visible in FIG. 2 is located on the outer surface 218 that faces out of the page. Optionally, when the connectors 102, 202 are in the mating orientation, the catch features 114, 214 may axially align with each other parallel to a mating axis 120 of the connectors 102, 202. Alternatively, the catch features 114, 214 may be axially offset from one another, such that one or both of the catch features 114, 214 do not align with the mating axis 120. The catch features 114, 214 are located proximate to the respective mating ends 108, 208 of the housings 106, 206. In an embodiment, the mating housing 206 is a duplicate of the housing 106, such that the mating catch features 214 of the mating housing 206 match the catch features 114 of the housing 106. As used herein, two different components or sets of components "match" when the two components (or sets) have the same sizes, shapes, numbers, locations, and orientations relative to the respective environment as one another, neglecting any inconsistencies attributable to production tolerances and/or defects during production or post-production. For example, the mating catch features 214 of the mating housing 206 may match the catch features 114 of the housing 106 even if one of the matching catch features 214 has a chipped edge and none of the catch features 114 has a chipped edge. The catch features 114, 214 in FIG. 2 are protrusions 122 (e.g., bosses) that project from the respective outer surfaces 118, 218. The protrusions 122 are cylindrical with circular cross-sections, but may have other shapes in other embodiments.

Figure 3:
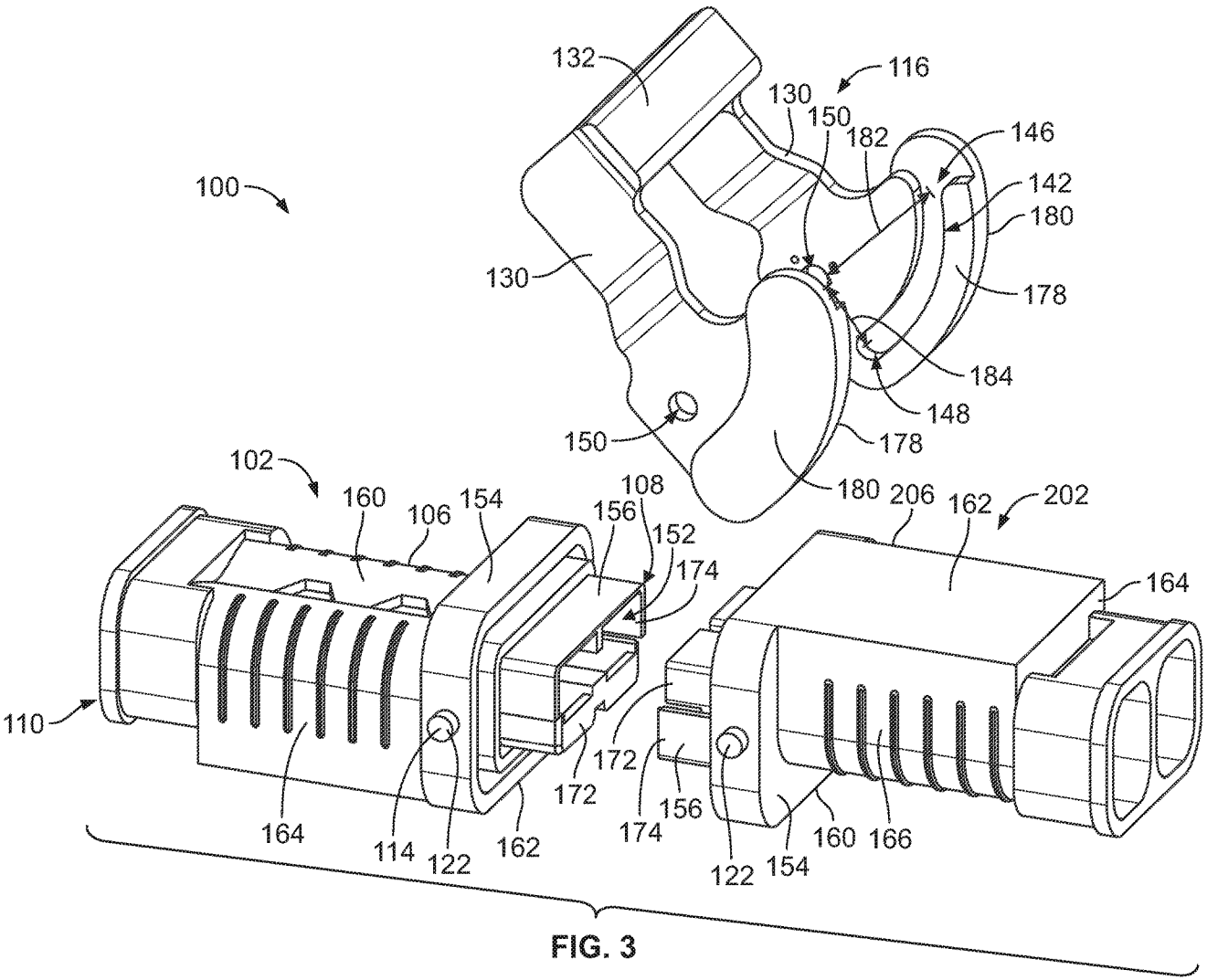
FIG. 3 is an exploded perspective view of the connection system according to the embodiment shown in FIGS. 1 and 2.

The lever 116 has two arms 130 and a handle 132 that extends between and couples to both of the arms 130. For example, the cross-section is taken through a portion of a first arm 130*a* of the two arms 130, and a second arm 130*b* of the two arms 130 is spaced apart from the first arm 130*a* by a length of the handle 132. The second arm 130*b* extends along an opposite side of the connection system 100 than the first arm 130*a*. The arms 130 couple to the housing 106 to mount the lever 116 to the first connector 102. The handle 132, as shown in more detail in FIG. 3, is configured to be grasped by a human operator, machine, or robot to actuate the lever 116 by pivoting the lever 116 relative to the housing 106. The lever 116 is pivotable between a lock position 134 and an unlock position 136. The lever 116 is in an intermediate position between the lock and unlock positions 134, 136 in FIG. 2, but the locations of the handle 132 when the lever 116 is in the lock and unlock positions 134, 136 are depicted in phantom. The lever 116 is designed such that the handle 132 is located more proximate to the outer surface 118 of the housing 106 when the lever 116 is in the lock position 134 than the proximity of the handle 132 to the outer surface 118 in the unlock position 136.

As the lever 116 is pivoted in a first (e.g., counter-clockwise) direction 138 relative to the housing 106 towards the lock position 134, the lever 116 is configured to engage the protrusions 122 (e.g., mating catch features 214) of the mating housing 206 to pull the mating housing 206 towards the housing 106. The lever 116 may linearly pull the mating housing 206 parallel to the mating axis 120. The two connectors 102, 202 may be fully mated upon the lever 116 reaching the lock position 134. To disconnect the connectors 102, 202, the lever 116 may be pivoted in a second (e.g., clockwise) direction 140 opposite the first direction 138 from the lock position 134 towards the unlock position 136. The movement of the lever 116 in the second direction 140 may push the protrusions 122 of the mating housing 206 away from the housing 106. The lever 116 may release the protrusions 122 of the mating housing 206 upon the lever 116 reaching the unlock position 136. Therefore, the lever 116 may provide forces during mating and un-mating, providing both a mating assist and an "un-mating" assist. In an alternative embodiment, the lever 116 may provide a mating assist without providing any force to aid in the un-mating of the connectors 102, 202 when the lever 116 is pivoted in the second direction 140. Prior to mating the connectors 102, 202, the lever 116 may be positioned in the unlock position 136 in order to properly engage and receive the protrusions 122. For example, the arms 130 of the lever 116 define cam slots 142 that receive the protrusions 122 of the mating housing 206 therein. The cam slots 142 have curved paths or trajectories. Edges 144 of the cam slots 142 along the curved trajectories push or pull the protrusions 122 based on the direction of movement of the lever 116 as the lever 116 is pivoted relative to the housings 106, 206. Each cam slot 142 extends from an open end 146 of the cam slot 142 to a closed end 148. The open end 146 defines an opening through which a corresponding protrusion 122 enters and exits the cam slot 142. The closed end 148 defines a hard stop surface that restricts movement of the protrusion 122 within the cam slot 142. Optionally, the protrusion 122 may only be able to be received through the open end 146 of the cam slot 142 when the lever 116 is in the unlock position 136.

In the illustrated embodiment, the lever 116 is mounted to the housing 106 of the first connector 102 via the protrusions 122 (e.g., catch features 114) of the housing 106. For example, the protrusions 122 are received into apertures 150 in the arms 130 of the lever 116. The lever 116 pivots about the protrusions 122, such that the protrusions 122 represent pivot axles as well as mounting protrusions. As shown in FIG. 2, the protrusions 122 of the first housing 106 mount the lever 116, and the matching protrusions 122 of the second housing 206 allow the lever 116 to grip and pull the second connector 202 towards the first connector 102 to provide a mating assist. In an embodiment, if the lever 116 is switched to the second connector 202, the lever 116 mounts to the protrusions 122 of the second housing 206, and grips and pulls the protrusions 122 of the first housing 106 to provide the mating assist.

Figure 4:
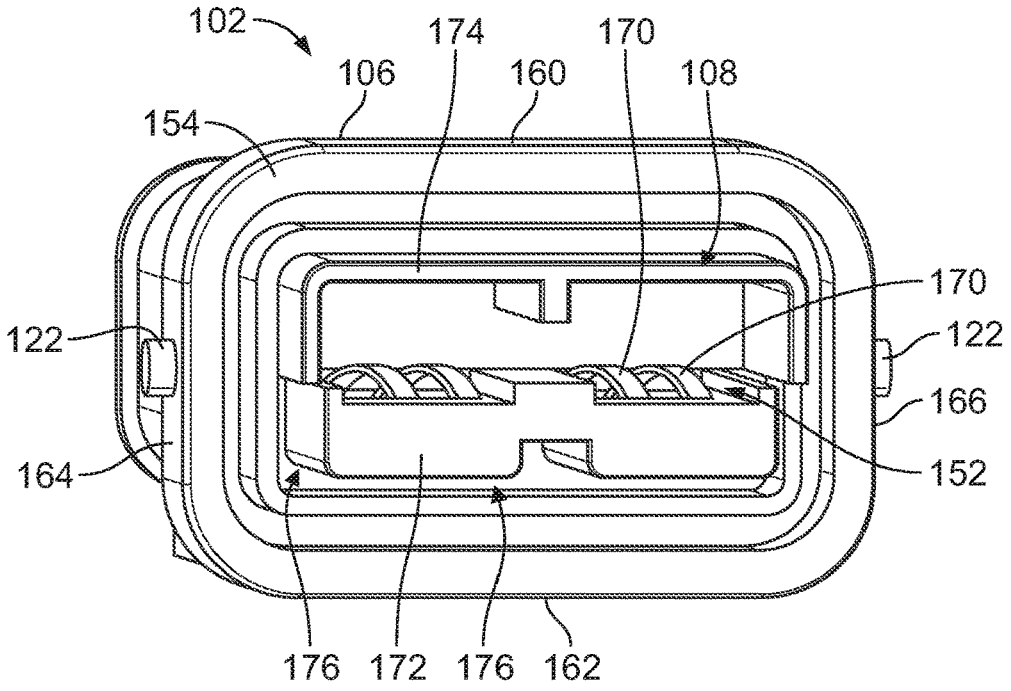
FIG. 4 is a front perspective view of the first connector of the connection system according to the embodiment shown in FIGS. 1-3.

FIG. 3 is an exploded perspective view of the connection system 100 according to the embodiment shown in FIGS. 1 and 2. FIG. 4 is a front perspective view of the connector 102 of the connection system 100. The housing 106 of the connector 102 is a duplicate of the mating housing 206 of the mating connector 202 in the illustrated embodiment, so the following description of the housing 106 also applies to the mating housing 206. For example, the mating connector 202 may look the same as the illustrated connector 102 in FIG. 4.

The housing 106 defines a cavity 152 that linearly extends through the housing 106 from the mating end 108 to the cable end 110. The electrical contacts 170 of the connector 102 are held within the cavity 152 proximate to the mating end 108. The cables 112 (FIG. 1) terminate to the contacts 170 within the cavity 152. The housing 106 optionally includes a flange portion 154 and a mating shroud 156 that projects beyond the flange portion 154 to the mating end 108. The protrusions 122 that define the catch features 114 may be located on the flange portion 154.

As shown in FIG. 4, the protrusions 122 are spaced apart along a perimeter of the housing 106. For example, the housing 106 in the illustrated embodiment includes two protrusions 122 that are disposed along opposite sides of the housing 106. The housing 106 has a rectangular prism shape with a first broad side 160, a second broad side 162 opposite the first broad side 160, a first narrow side 164, and a second narrow side 166 opposite the first narrow side 164. The first and second narrow sides 164, 166 extend from the first broad side 160 to the second broad side 162. One protrusion 122 is located on the first narrow side 164, and the other protrusion 122 is located on the second narrow side 166 in the illustrated embodiment. The two protrusions 122 project from the housing 106 in opposite directions. The protrusions 122 are each located at a vertical midpoint between the first and second broad sides 160, 162 in FIG. 4, but the protrusions 122 may be vertically offset from each other and/or offset from the midpoint in an alternative embodiment. The housing 106 may include only one protrusion 122 or more than two protrusions 122 in an alternative embodiment.

The electrical contacts 170 are held within the mating shroud 156. In the illustrated embodiment, the mating shroud 156 includes a tray 172 and a canopy 174. The electrical contacts 170 are deflectable leaf spring contacts in the illustrated embodiment, but it is recognized that the electrical contacts 170 may have various other shapes in other embodiments. The canopy 174 defines an upper perimeter of the mating shroud 156 in the orientation shown in FIG. 4, and the tray 172 defines a lower perimeter of the mating shroud 156. The housing 106 defines a channel 176 extending at least partially around the tray 172. When mating the connectors 102, 202, the canopy 174 of the mating housing 206 is received in the channel 176 and at least partially surrounds the tray 172 of the housing 106. During the mating operation, the electrical contacts 170 engage and electrically connect to corresponding contacts (not shown) of the mating connector 202. The mating end 108 of the housing 106 may have other shapes and features in alternative embodiments.

Referring to FIG. 3, the hermaphroditic duplicate housings 106, 206 of the connectors 102, 202 in an embodiment are configured to mate together in an inverted orientation. The housings 106, 206 are poised for mating, and the first broad side 160 of the housing 106 faces vertically upward, while the first broad side 160 of the mating housing 206 faces vertically downward. Likewise, the second broad side 162 of the housing 106 faces vertically downward, and the second broad side 162 of the mating housing 206 faces vertically upward. In the illustrated embodiment, the first broad side 160 has a contoured and curved surface, and the second broad side 162 has a planar or flat surface, but one or both of the sides 160, 162 may have a different surface topology in an alternative embodiment.

The lever 116 in the illustrated embodiment is symmetric about a line crossing through a midpoint of the handle 132 between the two arms 130. The cam slots 142 are defined along inner surfaces 178 of the arms 130. The inner surfaces 178 face towards each other (and face towards the housing 106 when mounted thereto). Optionally, the cam slots 142 do not extend fully through a thickness of the arms 130, such that the cam slots 142 are not defined along exterior surfaces 180 of the arms 130 that are opposite the inner surfaces 178. Each of the cam slots 142 is spaced apart from the aperture 150 that is defined along the same arm 130 of the lever 116. The distance between the aperture 150 and the corresponding cam slot 142 varies along the length of the cam slot 142 between the open end 146 and the closed end 148. For example, a distance 182 (e.g., radial distance) between the aperture 150 and the open end 146 is greater than a distance 184 between the aperture 150 and the closed end 148. Due to the curved path of the cam slot 142, as the lever 116 is pivoted towards the lock position 134 (FIG. 2), the protrusion 122 of the mating housing 206 moves along the length of the cam slot 142 towards the closed end 148, which pulls the protrusion 122 towards the aperture 150.

In an alternative embodiment, the mating housing 206 of the mating connector 202 defines cam slots along opposite outer surfaces thereof, and the lever 116 has protrusions instead of the cam slots 142 that are received within the cam slots of the mating housing 206. The cam slots of the mating housing 206 may resemble the cam slots 142 of the lever 116 shown and described in FIG. 3, such that pivoting movement of the lever 116 causes the protrusions of the lever 116 within the cam slots of the mating housing 206 to pull the mating housing 206 towards the housing 106.

Figure 5:
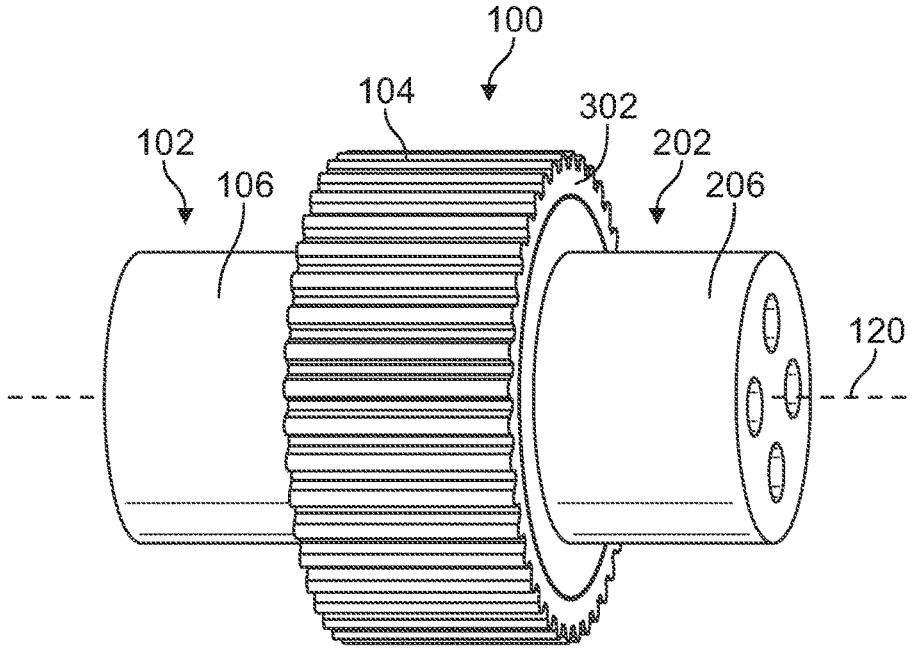
FIG. 5 is a perspective view of the connection system with the first and second connectors and the mating assist device according to another embodiment.
Figure 6:
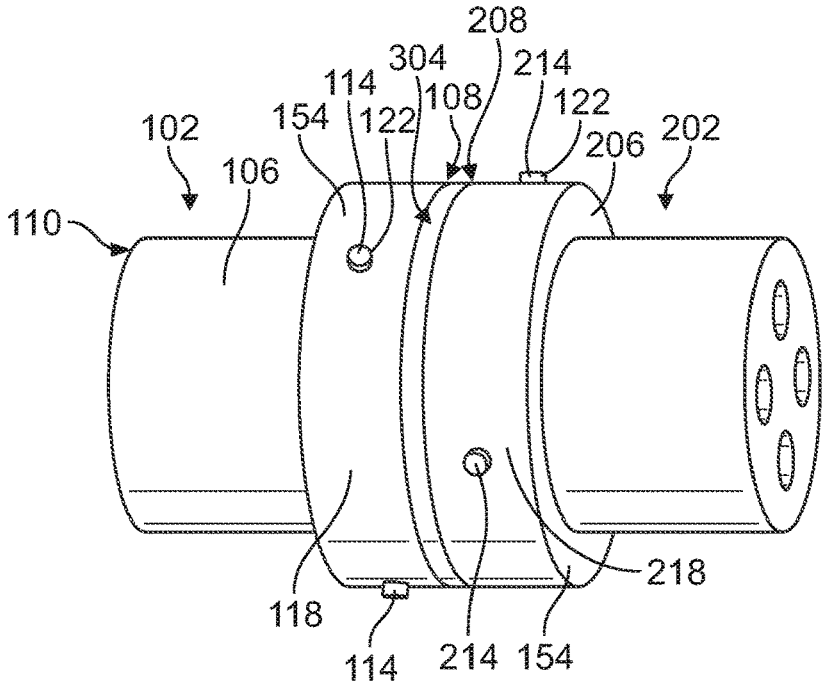
FIG. 6 is a perspective view of the first and second connectors according to the embodiment shown in FIG. 5 omitting the mating assist device.
Figure 7:
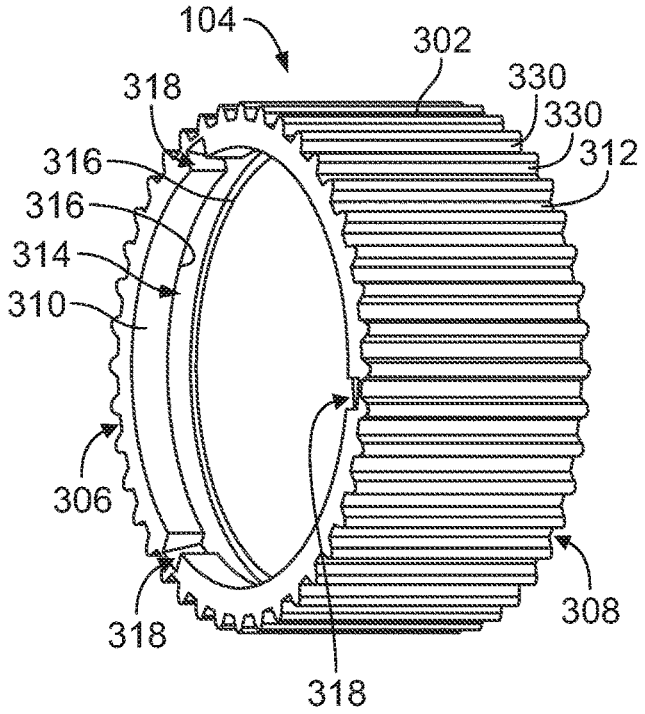
FIG. 7 is a first perspective view of the mating assist device according to the embodiment shown in FIG. 5.
Figure 8:
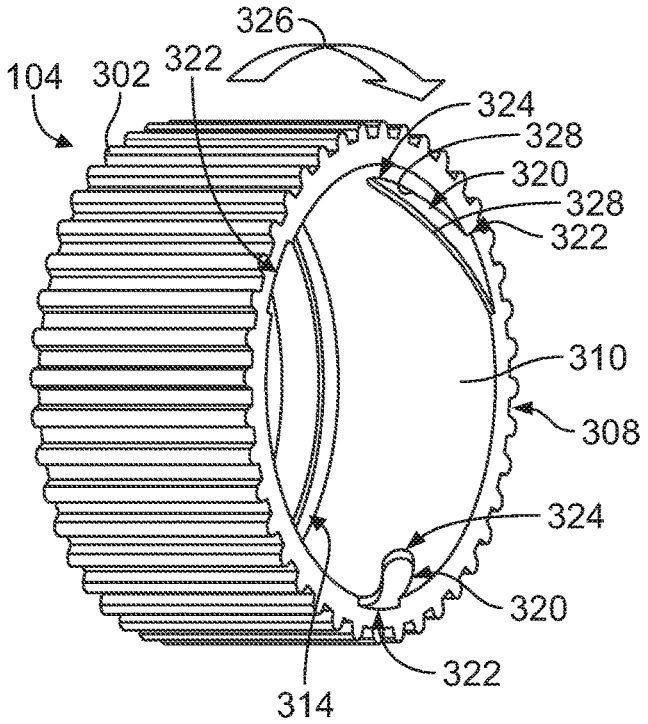
FIG. 8 is a second perspective view of the mating assist device shown in FIG. 7.

FIGS. 5-8 illustrate the connection system 100 with the first and second connectors 102, 202 and the mating assist device 104 according to another embodiment. The components of the connection system 100 in FIGS. 5-8 that are common to the embodiment shown in FIGS. 1-4 are labeled with the same reference numbers. FIG. 5 is a perspective view of the assembled connection system 100 with the first and second connectors 102, 202 in a fully mated position. FIG. 6 is a perspective view of the first and second connectors 102, 202 in the mated position omitting the mating assist device 104. FIG. 7 is a first perspective view of the mating assist device 104, in FIG. 8 is a second perspective view of the mating assist device 104. In the embodiment shown in FIGS. 5-8, the mating assist device is a twist lock sleeve 302.

Referring to FIG. 6, the housing 106 is hermaphroditic, and the mating housing 206 of the mating connector 202 is a duplicate of the housing 106. As such, the mating catch features 214 of the mating housing 206 match the catch features 114 of the housing 106. Although not shown in FIG. 6, the twist lock sleeve 302 is mounted to the housing 106 in the illustrated configuration, although the twist lock sleeve 302 can be reoriented and mounted to the mating housing 106 in an alternative configuration. The following description of the housing 106 is applicable to both housings 106, 206.

The housing 106 extends from the mating end 108 to the cable end 110. The housing 106 has a flange portion 154 proximate to the mating end 108, similar to the embodiment shown in FIGS. 1-4. The housing 106 and the flange portion 154 are cylindrical in the illustrated embodiment, but may have other shapes in other embodiments. The housings 106, 206 define a mating interface 304 at the mating ends 108, 208. The catch features 114 of the housing 106 and the catch features 214 of the mating housing 206 are protrusions 122 (e.g., bosses) that protrude from the respective outer surfaces 118, 218 of the housings 106, 206. Like the embodiment shown in FIGS. 1-4, the protrusions 122 of the housing 106 are located on the flange portion 154 and are spaced apart along a perimeter of the housing 106.

The twist lock sleeve 302 circumferentially surrounds the mating ends 108, 208 of the housings 106, 206 at the mating interface 304. The twist lock sleeve 302 mounts to the housing 106 of the first connector 102 via the protrusions 122 of the housing 106. The twist lock sleeve 302 is configured to engage the protrusions 122 of the mating housing 206 to provide mating assist for mating the connectors 102, 202. The twist lock sleeve 302 is rotatable relative to the housings 106, 206 about the mating axis 120. The twist lock sleeve 302 is configured to convert rotation of the twist lock sleeve 302 into linear motion of the two housings 106, 206 towards each other.

Referring now to FIG. 7, the twist lock sleeve 302 is cylindrical and extends from a mounting end 306 of the sleeve 302 to a mating end 308 of the sleeve 302. The twist lock sleeve 302 has an interior surface 310 and an exterior surface 312 that is opposite the interior surface 310. The twist lock sleeve 302 optionally has ribs 330 along the exterior surface 312 to make the sleeve 302 more graspable for an operator. The interior surface 310 faces the housings 106, 206. The twist lock sleeve 302 defines an annular groove 314 along the interior surface 310 proximate to the mounting end 306. The protrusions 122 of the housing 106 are received into the annular groove 314 and are retained within the annular groove 314 due to engagement with edges 316 of the annular groove 314. As the twist lock sleeve 302 rotates, the annular groove 314 moves relative to the protrusions 122 of the housing 106 while retaining the protrusions 122 in the groove 314. The engagement between the protrusions 122 and the edges 316 of the groove 314 axially secure the twist lock sleeve 302 on the housing 106 while allowing the twist lock sleeve 302 to rotate relative to the housing 106. The twist lock sleeve 302 may define passageways 318 that extend from the mounting end 306 to the annular groove 314. The protrusions 122 may be received into the annular groove 314 through the passageways 318 when mounting the twist lock sleeve 302 to the housing 106, and may be removed from the annular groove 314 through the passageways 318 when dismounting the twist lock sleeve 302 from the housing 106. In an alternative embodiment, the twist lock sleeve 302 may include deflectable latch members within the passageways 318 or instead of the passageways 318. Such latch members may be configured to deflect to allow the protrusions 122 to be received within the annular groove 314, and may resiliently return towards an undeflected position to block the protrusions 122 from exiting the annular groove 314.

Referring now to FIG. 8, the twist lock sleeve 302 defines cam slots 320 along the interior surface 310. The cam slots 320 are located proximate to the mating end 308 of the sleeve 302, and are axially spaced apart from the annular groove 314. Each of the cam slots 320 extends from the mating end 308 along a respective curved slot trajectory or path. The slot trajectories have both an axial dimension and a circumferential dimension. The cam slots 320 each have an open end 322 at the mating end 308, and extend along the curved trajectory to a closed end 324. The closed end 324 is located more proximate to the annular groove 314 than the proximity of the open end 322 to the annular groove 314. The closed end 324 is also spaced apart circumferentially from the open end 322. During the mating operation, the protrusions 122 of the mating housing 206 are received into different corresponding cam slots 320 of the twist lock sleeve 302 through the respective open ends 322. As the twist lock sleeve 302 is rotated relative to the housings 106, 206 in a locking direction 326, edges 328 of the cam slots 320 engage the protrusions 122 of the mating housing 206 and gradually pull the protrusions 122 (and the entire mating housing 206) linearly towards the housing 106 to provide mating assist. Rotating the twist lock sleeve 302 in the opposite direction may push the protrusions 122 of the mating housing 206 away from the housing 106 to unmate the connectors 102, 202.

Figure 9:
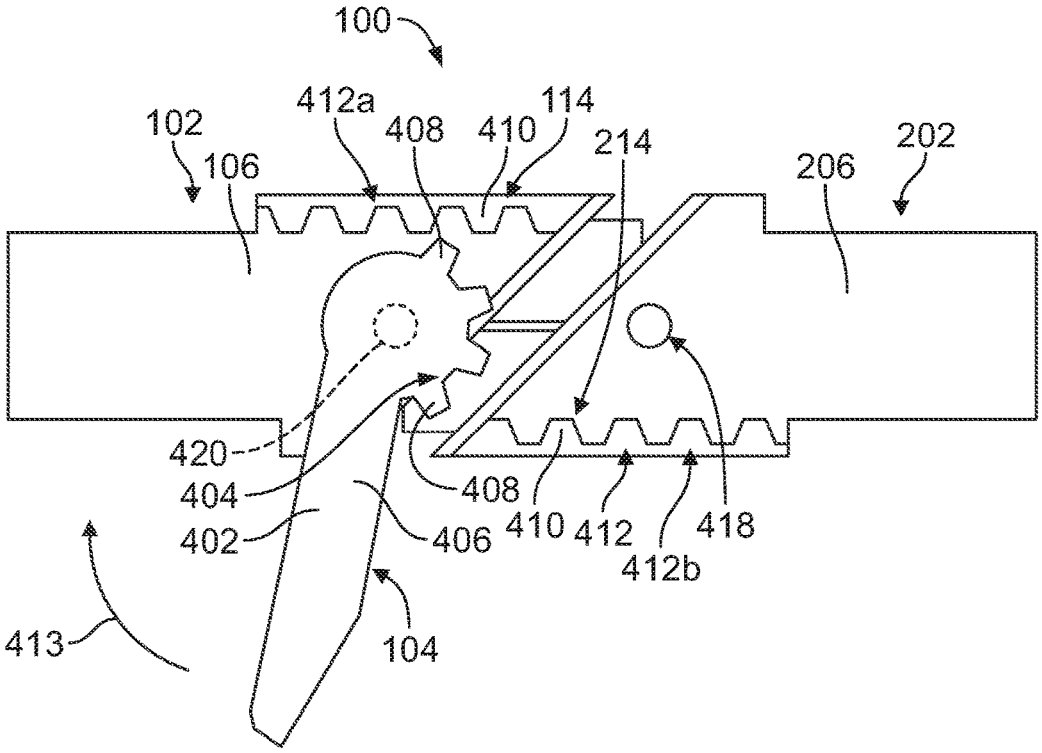
FIG. 9 is a side view of the connection system according to another embodiment.

FIG. 9 is a side view of the connection system 100 according to another embodiment. The components of the connection system 100 in FIG. 9 that are common to the embodiments shown in FIGS. 1-8 are labeled with the same reference numbers. In the illustrated embodiment, the mating assist device 104 is a lever 402. The lever 402 includes a curved pinion segment 404 along an arm 406 of the lever 402. The curved pinion segment 404 has multiple teeth 408 (e.g., gear teeth). The lever 402 is mounted to the housing 106 of the first connector 102.

In the illustrated embodiment, the mating catch features 214 of the mating housing 206 are teeth 410 (e.g., gear teeth) on a linear rack bar 412 of the mating housing 206. The teeth 410 protrude from the outer surface 218 of the mating housing 206. The teeth 408 of the lever 402 are configured to engage the teeth 410 on the linear rack bar 412 during the mating operation. For example, as the lever 402 is pivoted in a locking direction 413, the teeth 408 of the lever 402 engage corresponding teeth 410 of the linear rack bar 412 on the mating housing 206 to pull the mating housing 206 towards the housing 106. Thus, the mating assist in the illustrated embodiment is a rack and pinion mechanism.

Like the other embodiments described herein, the housings 106, 206 are hermaphroditic, and the mating housing 206 is a duplicate of the housing 106. Thus, the housing 106 includes a linear rack bar 412*a* that is a duplicate of the linear rack bar 412*b* of the mating housing 206. In the illustrated embodiment, the lever 402 is mounted to the housing 106 via an axle 420 that is discrete and spaced apart from the teeth 410 of the linear rack bar 412*a* (that define the catch features 114). The axle 420 may be an integral component of the lever 402, and may be received into an aperture 418 in the housing 106 to couple the lever 402 to the housing 106. It is recognized that the lever 402 mounted on the housing 106 does not engage the linear rack bar 412*a* on the housing 106. Thus, the linear rack bar 412*a* of the housing 106 is nonfunctional in the illustrated configuration, but would be functional in an alternative configuration in which the lever 402 is mounted to the mating housing 206.

At least one technical effect of the connection system described herein is the ability to selectively mount the mating assist device to the connectors, which enables an operator to decide whether or not to utilize the mating assist device for a given installation task without having to purchase different connectors. The connection system provides additional configuration flexibility by allowing the operator to select which of the connectors to mount the mating assist device, which may be useful based on space restrictions and accessibility restrictions in the installation environment. Another technical effect of the connection system described herein is a reduced cost during manufacturing relative to connection systems that have connectors with differing features because only a single housing component is manufactured that can be used for both mating connectors. The connection system described herein may also reduce costs for the operator that installs and assembles the connectors by enabling the operator to buy a single housing component for use in each of the mating connectors.

As used herein, relative or spatial terms such as "upper," "lower," "inner," "outer," "front," and "back" are only used to distinguish the referenced elements and do not necessarily require particular positions or orientations relative to gravity and/or the surrounding environment of the connection system 100.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connection system comprising:

a first electrical connector including a first housing that has a mating end;

a second electrical connector including a second housing that has a mating end, wherein the second housing is a duplicate of the first housing, the mating end of the first housing configured to mate to the mating end of the second housing during a mating operation, wherein the first and second electrical connectors include protrusions located at identical positions along an outside surface of the first and second housings; and a mating assist device mounted to one of the first and second housings by attachment with the protrusions of either the first or second housing, the mating assist device being configured to engage the protrusions of the other of the first or second housing, wherein the mating assist device is configured to be rotated or pivoted relative to both the first and second housings to linearly pull the second electrical connector towards the first electrical connector during a mating operation via engagement of the unattached portion of the mating assist device with the protrusions.

2. The connection system of claim 1, wherein each of the first and second housings has a cable end opposite the respective mating end and defines a linear cavity from the mating end to the cable end.

3. The connection system of claim 1, wherein the first and second housing each have a first side and a second side opposite the first side, wherein the first and second housings are configured to mate together in an inverted orientation such that the first side of the first housing generally aligns with the second side of the second housing and the second side of the first housing generally aligns with the first side of the second housing.

4. The connection system of claim 1, wherein the mating assist device is a lever.

5. The connection system of claim 4, wherein lever is pivotable between an unlock position and a lock position, wherein a handle of the lever is located more proximate to an outer surface of the first housing on which the lever is mounted in the lock position than in the unlock position.

6. The connection system of claim 4, wherein the lever is mounted to the first housing via the protrusions on the first housing and pivots about the protrusions on the first housing, and wherein the lever engages the protrusions on the second housing such that movement of the lever causes the first and second housings to be mover linearly towards one another.

7. The connection system of claim 1, wherein the protrusions on the first and second housing comprise a pair of protrusions, wherein each protrusion is spaced apart around a perimeter of the respective first and second housing.

8. The connection system of claim 1, wherein the protrusions are teeth on a linear rack bar protruding from the outer surface of the second housing, and the mating assist device includes a curved pinion segment having multiple teeth that engage the teeth of the linear rack bar.

9. The connection system of claim 1, wherein the mating assist device is a twist lock sleeve that circumferentially surrounds the first and second housings at a mating interface, the twist lock sleeve defining cam slots along an interior surface thereof that are configured to receive the protrusions of the second housing therein.

10. The connection system of claim 9, wherein the cam slots extend from a mating end of the twist lock sleeve along respective slot trajectories, each of the slot trajectories having both an axial dimension and a circumferential dimension.

11. An electrical connector comprising:

a housing defining a mating end and holding one or more electrical contacts, the housing including multiple catch features protruding from an outer surface of the housing, wherein the housing is hermaphroditic such that the mating end of the housing is configured to mate with a mating housing that is a duplicate of the housing and has mating catch features matching the catch features of the housing; and a mating assist device mounted to the housing proximate to the mating end, the mating assist device configured to rotate or pivot relative to the housing during a mating operation to engage the mating catch features and linearly pull the mating housing towards the housing, wherein the mating assist device is mountable with the mating catch features of either housing to engage the mating catch features of the other of the housing.

12. The electrical connector of claim 11, wherein the mating assist device is mounted to the housing via the catch features that protrude from the outer surface of the housing.

13. The electrical connector of claim 12, wherein the mating assist device is a lever and the catch features of the housing are protrusions, the lever configured to pivot about the protrusions, wherein the lever defines cam slots that are configured to receive protrusions therein that define the mating catch features.

14. The electrical connector of claim 12, wherein the mating assist device is a twist lock sleeve and the catch features of the housing are protrusions, the twist lock sleeve defining an annular groove along an interior surface thereof that receives the protrusions of the housing therein to allow the twist lock sleeve to rotate relative to the housing, the twist lock sleeve also defining cam slots along the interior surface that are configured to receive protrusions therein that define the mating catch features.

15. The electrical connector of claim 11, wherein the mating assist device is a lever that is mounted to the housing via axles that are discrete and spaced apart from the catch features of the housing.

16. The electrical connector of claim 15, wherein the catch features of the housing are teeth on a linear rack bar that do not engage the lever mounted to the housing, wherein the lever includes a curved pinion segment having multiple teeth configured to engage teeth of a linear rack bar that define the mating catch features.

17. An electrical connector comprising:

a housing defining a mating end and holding one or more electrical contacts, the housing including multiple protrusions protruding from an outer surface of the housing along opposite sides of the housing, wherein the housing is hermaphroditic such that the mating end of the housing is configured to mate with a mating housing that is a duplicate of the housing and has mating protrusions matching the protrusions of the housing, a lever mounted to the housing via the protrusions and pivotable about the protrusions, the lever defining cam slots configured to receive the mating protrusions therein during a mating operation to linearly pull the mating housing towards the housing as the lever is pivoted relative to the housing, wherein the lever is mountable with the protrusions of either housing to engage the protrusions of the other of the housing.

18. The electrical connector of claim 17, wherein the lever includes two arms, each of the arms defining an aperture that receives a corresponding one of the protrusions of the housing therein to mount the lever to the housing, each of the arms defining one of the cam slots along an inner surface thereof that faces the housing, the cam slots spaced apart from the apertures.

19. The electrical connector of claim 18, wherein each of the cam slots has a curved trajectory that extends from an open end of the cam slot to a closed end of the cam slot, wherein a radial distance between the closed end and the aperture of the corresponding arm is less than the radial distance between the open end and the aperture.

20. The electrical connector of claim 17, wherein the mating end of the housing is configured to mate with the duplicate mating housing in an inverted orientation.

* * * * *